US009113738B2

(12) United States Patent
Hoffman

(10) Patent No.: US 9,113,738 B2
(45) Date of Patent: Aug. 25, 2015

(54) DEVICE AND SYSTEM FOR ASSISTING HOSIERY DONNING

(71) Applicant: Ervin Hoffman, Brooklyn, NY (US)

(72) Inventor: Ervin Hoffman, Brooklyn, NY (US)

( * ) Notice: Subject to any disclaimer, the term of this patent is extended or adjusted under 35 U.S.C. 154(b) by 0 days.

(21) Appl. No.: 13/794,636

(22) Filed: Mar. 11, 2013

(65) Prior Publication Data

US 2014/0008400 A1 Jan. 9, 2014

Related U.S. Application Data

(60) Provisional application No. 61/608,703, filed on Mar. 9, 2012.

(51) Int. Cl.
*A47G 25/90* (2006.01)

(52) U.S. Cl.
CPC ..... *A47G 25/905* (2013.01)

(58) Field of Classification Search
CPC ..... A47G 25/905
USPC ..... 223/111, 113, 116, 118–119
See application file for complete search history.

(56) References Cited

U.S. PATENT DOCUMENTS

| | | | | | |
|---|---|---|---|---|---|
| 2,443,115 | A * | 6/1948 | Park | 223/111 |
| 3,727,812 | A * | 4/1973 | Weiss | 223/111 |
| 4,072,255 | A * | 2/1978 | Bogorad | 223/111 |
| 4,130,226 | A * | 12/1978 | Farrell | 223/111 |
| 7,337,933 | B1 * | 3/2008 | Klinberg | 223/118 |
| 7,988,022 | B1 * | 8/2011 | Hansson et al. | 223/111 |
| 2007/0095866 | A1 * | 5/2007 | Zumbach | 223/111 |
| 2010/0006609 | A1 * | 1/2010 | McAllister et al. | 223/111 |
| 2013/0214016 | A1 * | 8/2013 | Carbray | 223/111 |

OTHER PUBLICATIONS http://www.merriam-webster.com/dictionary/clamp; Oct. 1, 2014.*

* cited by examiner

*Primary Examiner* — Shaun R Hurley
*Assistant Examiner* — Andrew W Sutton
(74) *Attorney, Agent, or Firm* — Israel Nissenbaum; Yitzy Nissenbaum

(57) ABSTRACT

A system device for use in assisting in the donning of hosiery by elderly or handicapped persons. The device comprises at least two releasably grasping elements configured to separately releasable grasp the sides of an article of hosiery adjacent an open end thereof. The grasping elements are solidly affixed to respective elongated pulling elements of a length to enable a donner of the article of hosiery to position the article of hosiery over a foot with minimal reaching, bending or stretching of arms, legs or body and wherein the pulling elements are configured to enable the donner to pull the article of hosiery onto the foot into a donning position.

4 Claims, 3 Drawing Sheets

DEVICE AND SYSTEM FOR ASSISTING HOSIERY DONNING

FIELD OF THE INVENTION

This invention relates to devices, systems and methods for assisting in the donning of socks and stockings and particularly for assisting elderly, obese or handicapped persons in donning hosiery.

BACKGROUND

Because the donning of hosiery requires a wearer to extend the arms toward the feet and the necessity of applying a pulling pressure, to draw the socks or stockings on the feet and legs, such donning is often difficult for the obese and the elderly. Various expedients have been proposed or developed to assist in the donning of hosiery such as socks and stockings. Most of these expedients have related to devices for holding the socks or stockings in a fixed open position for insertion of the feet. However, such devices, because of the operational purposes, are often bulky and not amenable to transport and use as compact elements.

SUMMARY OF THE INVENTION

It is accordingly an object of the present invention to provide a system for assisting in the donning of hosiery such as socks and stockings, which is compact and portable and is adaptable for easy use by the obese, handicapped and elderly.

Generally, the present invention comprises a system device for use in assisting in the donning of hosiery by elderly or handicapped persons. The device comprises at least two releasably grasping elements configured to separately releasable grasp the sides of an article of hosiery adjacent an open end thereof. The grasping elements are solidly affixed to respective elongated pulling elements of a length to enable a donner of the article of hosiery to position the article of hosiery over a foot with minimal reaching, bending or stretching of arms, legs or body. The pulling elements are configured to enable the donner to pull the article of hosiery onto the foot into a donning position.

The releasable grasping elements preferably comprise releasable spring loaded clips having a holding strength sufficient to permit the article of hosiery onto the foot without inadvertent release prior to the donning.

The elongated pulling elements are preferably comprised of telescoping rods configured to collapse to a minimal carrying length and to be telescopically expanded to the length to enable the donner to position the article of hosiery over a foot and to pull it onto the foot into the donning position.

In a further optional embodiment, the releasable grasping elements are respectively connected to remotely controlling releasing elements configured to permit remote releasing of the grasping elements from the article of hosiery alter the foot is in the donning position.

The system further preferably comprises at least one curved element which is configured to grasp and rigidity sides of the article of hosiery at an open end thereof for facilitated grasping of the article of hosiery by the grasping elements with the grasping elements engaging the curved elements and the article of hosiery and wherein the curved element provides an opening sufficient for the foot to pass into the open end for donning of the article of hosiery. The system more preferably comprises two separated curved elements, with each configured to engage a side of the article of hosiery at the open end thereof with the curved elements each comprising a hinged curved member and a hosiery engaging element therebetween.

In accordance with the invention there is a gripping of the open end of the sock or stocking with an extension element which grips the open end of the sock or stocking and keeps it open for insertion of the foot and wherein the extension element enables the donner to remotely pull the sock or stocking onto the foot. After the sock or stocking is in place, a release mechanism remotely disconnects the gripping extension element from the sock or stocking to complete the donning. The release mechanism is a preferable embodiment since in many instances, the wearer is more easily capable of manually releasing the extension elements from the hosiery without the necessity for uncomfortable or incapable stretching.

In a preferred embodiment, the present invention comprises a device or system of two separate telescoping rods, each of which has a handle section at one end of the rod and a locking fastening clip at the other end. In a preferred embodiment, a hard framing element, preferably foldable or with separable elements for portability and operation, and configured to be non-slippingly engaged with the edge of the sock or stocking at the foot insertion open end thereof, is used to enhance engagement with the fastening clip. The framing element serves to prevent stretching or tearing of the sock caused by engagement with a fastening clip and pulling pressure used for donning. The framing elements should be circumferentially open or openable or even of separable elements to permit removal from the hosiery after a foot has passed through it.

The telescoping rods collapse to a preferable length of under a foot, for portability, and extend to a length of between about 1 and a half to three feet or generally a distance between a users hand and a sock or stocking, sufficient to accommodate the legs of the user to insert a foot into the sock. The other end of the rod is integrated with a fastening element such as a suspender clip or other releasable clip which provides a positive clipping and holding and resistant to inadvertent opening.

In operation, the telescoping rods are fixedly clipped to the right and left sides of a sock or stocking to be donned and the rods are extended. The device is utilized with the simultaneous engagement and operation of both rods to effect both the insertion of the foot into the sock or stocking and the drawing of the sock or stocking onto the foot. With thin or stretchy socks or stocking, the framing element is inserted into the open end of the sock or stocking and the end is engaged with the framing element or wrapped therearound. The clips of the telescoping rods engage the framing element together with the end of the sock or stocking.

The rods are manipulated by the user to draw the socks or stockings, from a distance, onto the respective feet and they are pulled to complete the placement of the sock or stockings onto the feet. The framing element permits the clips to be used with the socks or stocking without damaging stretching effect on the socks or stockings. The framing elements are separable for removal from the feet and the rods preferably contain a remotely controlled clip releasing element by which the user can disengage the rods from the socks or stockings after they have been donned. Alternatively, the clips may be manually, more easily opened and removed, with an easier effort than with the stretching motion required for the donning of the hosiery without the present device. Thereafter the fastening clips are engaged with the second sock or stocking (with or without framing element) for donning on the second foot. A remotely controlled element such as a pull rod or cable passing through or on the outer surface of the telescoping rods is optionally controllably affixed to the fastening clip. The remotely controlled element releases the fastening clip for removal of the donning assisting device.

The invention is more clearly shown with the following drawings in which:

SHORT DESCRIPTION OF THE DRAWINGS

DETAILED DESCRIPTION OF THE INVENTION AND DRAWINGS

Figure 1:
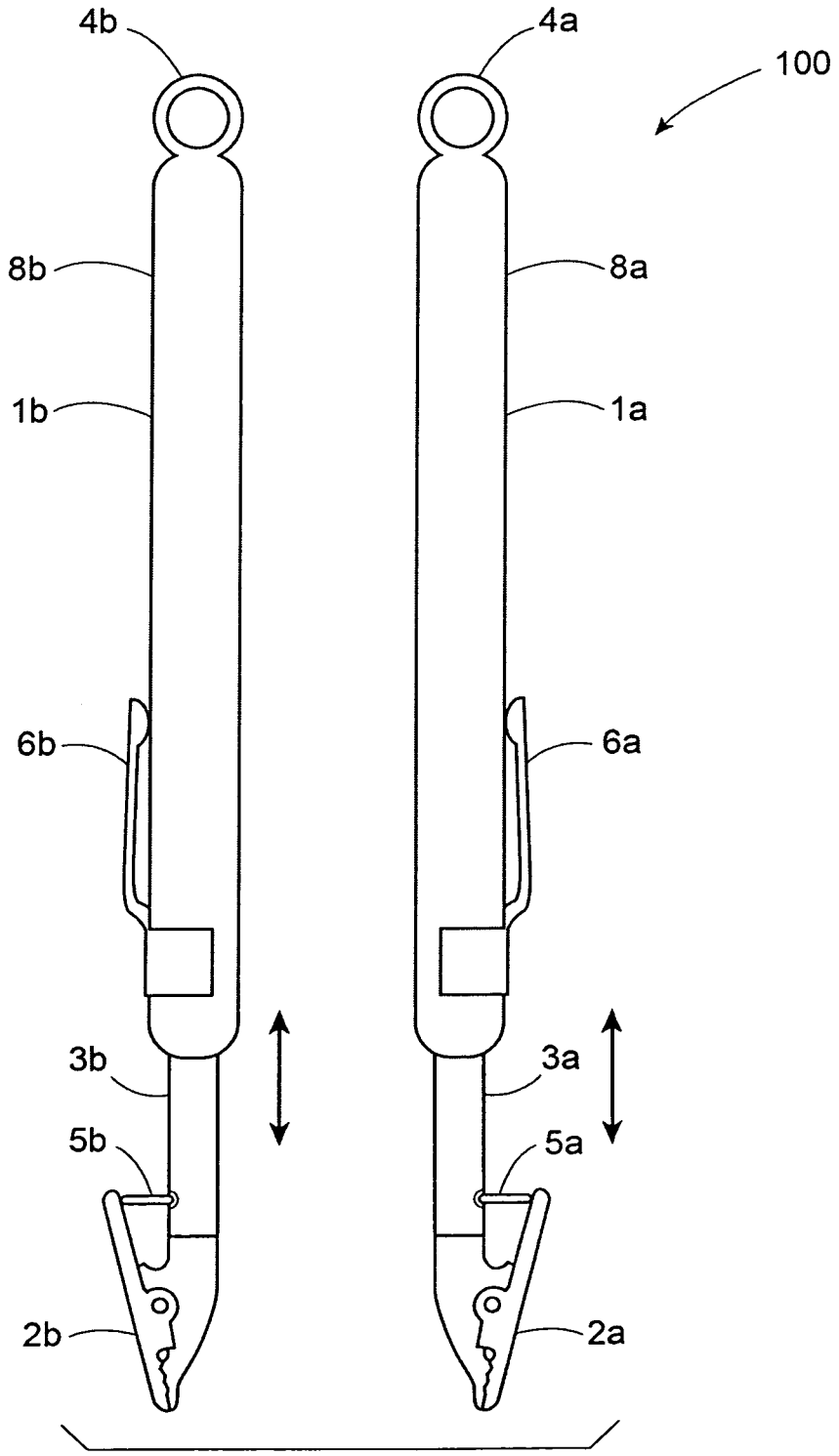
FIG. 1 is a side view of a pair of identical telescoping rods in the collapsed position with clips and releasing elements.
Figure 2:
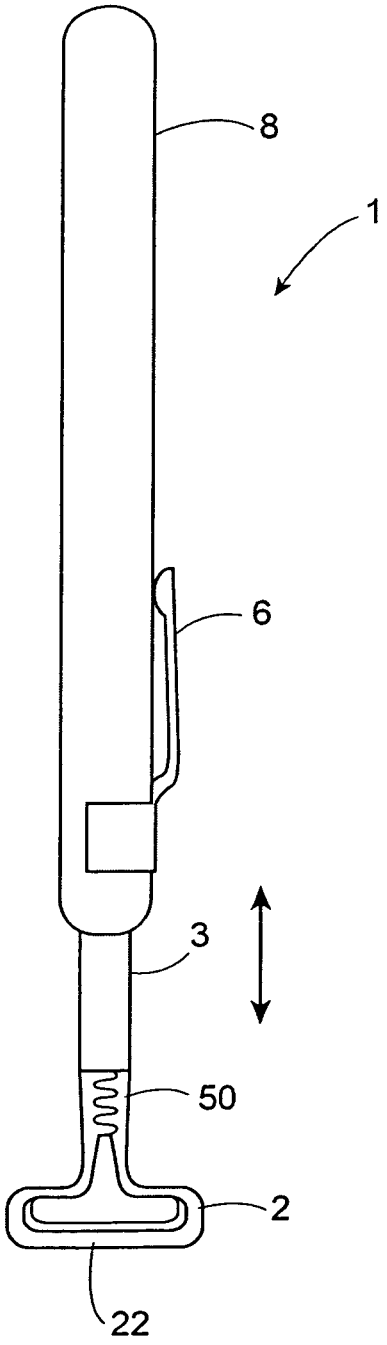
FIG. 2 is a front view of one of the telescoping rods of FIG. 1.

FIG. 1 depicts the hosiery donning element 100 comprised of two identical telescoping rods 1*a* and 1*b* turned in opposing directions for simultaneous use with the left and right sides respectively of hosiery such as socks or stockings (not shown). The rods comprise proximal grasping handles 8*a* and 8*b*, optional clip holders 6*a* and 6*b* of a pen type holding structure, and a nested set of telescoping rods 3*a* and 3*b* which respectively permit the rods 1*a* and 1*b* to be elongated in the directions shown by the arrows, distally disposed releasable clip elements 2*a* and 2*b* are affixed to the ends of the telescoping rods. As shown in FIG. 2 as illustrative of either one of the identical rods 1*a* and 1*b*), the clip element 2 of the rod 1 is a preferably widened laterally with widened gripping section 22, to provide a more secure and less damaging grip of the open ends of the hosiery, during donning. Elements 5*a* and 5*b* in FIG. 1 and element 5 of FIG. 2 are optional remote releasing elements used to effect release of the clips from the hosiery to permit remote adjustment or removal of the clips from the hosiery without the need for bending or stooping. Elements 5*a*, 5*b* and 5 are illustrated as mechanical pull cords or rods, the activation of which pulls clips 2*a*, 2*b* and 2 out of clip engagement with hosiery.

Figure 3:
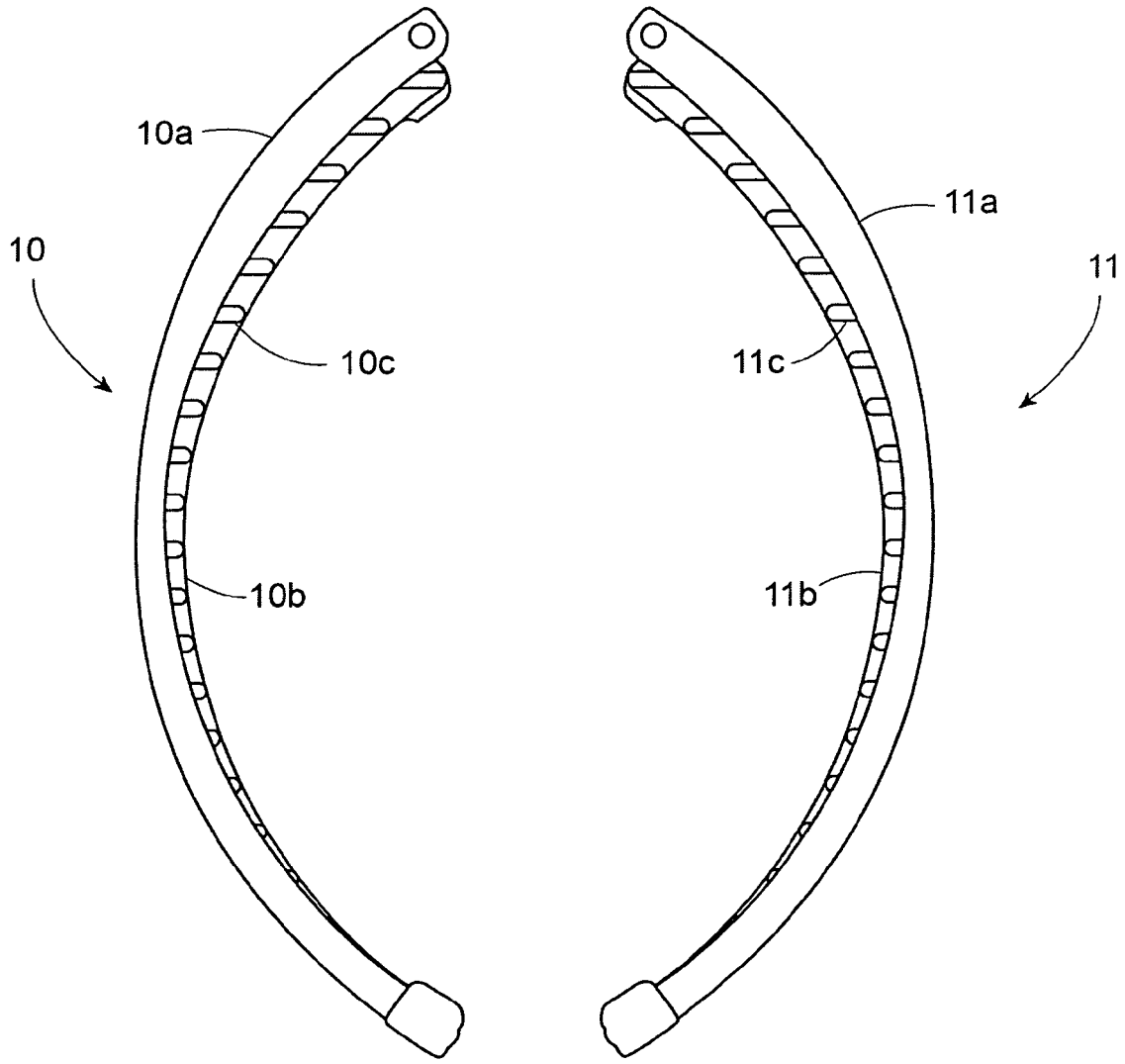
FIG. 3 is a view of the framing element in the respective closed positions, with each of the elements being separably openable as a sock or stocking and retaining element.

In a highly preferred embodiment, the telescoping rod clips of FIGS. 1 and 2 are supplemented with use of curved elements 10 and 11 shown in FIG. 3 and which are identical and which are used to provided rigidity to the open end of the hosiery grasped by the clips 2*a* and 2*b* of telescoping rods 1*a* and 1*b*. Each of the curved elements is in the form of an openable and closable double hinged arc of a relatively hard material such as an engineered plastic used with combs. In fact, the elements 10 and 11 are similar in structure and composition to a type of typical hair clip hinged at ends 10' and 10" and 11' and 11" respectively of elements 10 and 11 with a toothed engagement therein. The hinges hold curved elements 10*a* and 10*b* and 11*a* and 11*b* in open and closed configuration (with the closed configuration shown in FIG. 3) with engaging and disengaging toothed elements 10*c* and 11*c* for holding engagement and disengagement with the hosiery ends.

Hosiery is donned by initial engaging insertion of the curved elements 10 and 11 into right and left sides of an open end of a sock or stocking. Clips of rods 1*a* and 1*b* are engaged with the curved elements 10 and 11 at the open end of the sock or stock or stocking and the rod is telescopically at 3*a* and 3*b* opened to a suitable length whereby the donner positions the sock or stocking at a distance, without stooping or bending, onto a foot and draws the rods upward by grasping on handles 8*a* and 8*b* with passing of curved elements 10 and 11 around the foot until the sock or stocking is fully donned. Ring elements 4*a* and 4*b* are then pulled to transmit forces to disengaging elements 5*a* and 5*b* which draw the clips 2*a* and 2*b* open for release of the sock or stocking. Curved elements 10 and 11 are then removed. If the sock or stocking is of sufficient structural integrity, such elements need not be used. A second sock or stocking is donned by repeating the procedure.

It is understood that the structure of the grasping element may vary, as well as the order of the donning procedure and that other structures such as of the release elements which are also optional with clip removal being easier than donning which may involve uncomfortable or difficult body extensions. It is understood that the embodiments shown in the drawings are simply illustrative of the invention and that other changes in structure and donning procedure may be possible without departing from the scope of the invention as defined in the following claims.

What is claimed is:

1. A portable system device configured to be pocket carryable, for use in assisting in the donning of an article of hosiery by an elderly, obese or handicapped person, the article of hosiery having an open end with a continuous circular periphery through which a foot of the person is inserted, the portable system device comprising:

a) at least two separate releasable grasping clamping elements;

b) at least two separate elongated pulling elements being respectively solidly affixed to respective grasping clamping elements;

c) at least one curved solid element separate from the grasping clamping elements and the elongated pulling elements, which curved element is configured to be directly removably engaged with the circular periphery of the open end of the article of hosiery to rigidify sides of the article of hosiery at the open end thereof, whereby the circular periphery of the open end of the article of hosiery is enabled to be directly grasped by the grasping clamping elements without detrimental stretching or tearing thereof, with the grasping clamping elements directly engaging and clamping the curved element and the periphery of the open end of the article of hosiery at opposite sides of the open end and wherein the curved element is configured to provide an opening sufficient for the foot of the person to pass into and through the open end for donning of the article of hosiery, with the at least one curved element being separate from the grasping clamping element and removable from the article of hosiery when the foot is in a donned position, wherein the separate elongated pulling elements being of a length to enable the person to position the article of hosiery over a foot with minimal reaching, bending or stretching of arms, legs or body and wherein the pulling elements are configured to enable the person to pull the article of hosiery onto the foot into a donning position, wherein the elongated pulling elements are comprised of telescoping rods configured to collapse to a minimal pocket carrying length of under a foot and to be telescopically expanded to the length of between one and a half and three feet, sufficient to enable the donner to position the article of hosiery over a foot and to pull it onto the foot into the donning position.

2. The portable system device of claim 1, wherein the releasable grasping clamping elements comprise releasable spring loaded clips having a clamping holding strength sufficient to permit the article of hosiery to be pulled onto the foot without inadvertent release prior to donning thereof.

3. The portable system device of claim 1, wherein the releasable grasping clamping elements are respectively connected to remotely controlling releasing elements configured to permit remote releasing of the grasping clamping elements from the article of hosiery after the foot is in the donning position.

4. The portable system device of claim 1, wherein the system comprises two separated curved elements, with each configured to engage a side of the article of hosiery at the open end thereof.

* * * * *